US009672971B2

(12) United States Patent
Ohtsubo et al.

(10) Patent No.: US 9,672,971 B2
(45) Date of Patent: Jun. 6, 2017

(54) COIL PART

(71) Applicant: Panasonic Intellectual Property Management Co., Ltd., Osaka (JP)

(72) Inventors: Mutsuyasu Ohtsubo, Hyogo (JP); Ryusuke Teramoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/103,430

(22) PCT Filed: Jan. 7, 2015

(86) PCT No.: PCT/JP2015/000025
§ 371 (c)(1),
(2) Date: Jun. 10, 2016

(87) PCT Pub. No.: WO2015/115024
PCT Pub. Date: Aug. 6, 2015

(65) Prior Publication Data

US 2016/0307694 A1 Oct. 20, 2016

(30) Foreign Application Priority Data

Jan. 30, 2014 (JP) ..... 2014-015249
Aug. 21, 2014 (JP) ..... 2014-168156

(51) Int. Cl.
*H01F 27/29* (2006.01)
*H01F 17/04* (2006.01)

(52) U.S. Cl.
CPC ..... *H01F 27/292* (2013.01); *H01F 17/04* (2013.01); *H01F 27/29* (2013.01); *H01F 2017/048* (2013.01)

(58) Field of Classification Search
CPC ..... H01F 27/00–27/30; H01F 5/00
(Continued)

(56) References Cited

U.S. PATENT DOCUMENTS 6,204,744 B1 3/2001 Shafer et al.
2002/0067237 A1* 6/2002 Nakata ..... H01F 27/29 336/212
(Continued)

FOREIGN PATENT DOCUMENTS

JP 9-120926 5/1997
JP 9-251916 9/1997
(Continued)

OTHER PUBLICATIONS

International Search Report of PCT application No. PCT/JP2015/000025 dated Feb. 24, 2015.

*Primary Examiner* — Tuyen Nguyen
(74) *Attorney, Agent, or Firm* — McDermott Will & Emery LLP

(57) ABSTRACT

A coil component includes a coil section and an outer package made of magnetic material in which the coil section is embedded. Both ends of the coil section are drawn out as outer electrodes from a first lateral face of the outer package, and the drawn-out sections are bent toward a bottom face of the outer package, and further bent along the bottom face and a second lateral face, then bent toward a cut-out section provided to the top face of the outer package before engaged with the cut-out section. Recesses are provided on the bottom face at places where the outer electrodes overly, and the outer electrodes are bent toward the recesses, respectively. Inside the bent section of each of the outer electrodes, a notch is formed and the notch includes an opening that spreads over the two faces. A vertex portion of the bent section inside the notch is curved.

13 Claims, 8 Drawing Sheets

(58) Field of Classification Search
USPC ..... 336/65, 83, 192, 200, 220–223, 232
See application file for complete search history.

(56) References Cited

U.S. PATENT DOCUMENTS

| | | | | |
|---|---|---|---|---|
| 2013/0154780 | A1* | 6/2013 | Yamada | H01F 17/043 336/175 |
| 2014/0097921 | A1* | 4/2014 | Ohtsubo | H01F 27/292 336/83 |
| 2015/0287520 | A1* | 10/2015 | Takagi | H01F 27/29 336/170 |

FOREIGN PATENT DOCUMENTS

| | | |
|---|---|---|
| JP | 2005-310868 | 11/2005 |
| JP | 2010-123864 | 6/2010 |
| JP | 2013-045871 | 3/2013 |
| JP | 2014-132630 | 7/2014 |

* cited by examiner

COIL PART

TECHNICAL FIELD

The present invention relates to a coil component to be used in a variety of electronic devices, and more particularly it relates to a coil component working with a large current.

BACKGROUND ART

In recent years, a number of coil components has been used for working with large current in a DC/DC converter circuit and the like disposed near a car engine.

FIG. 16 is a lateral view of a conventional coil component mounted to a mounting board. The conventional coil component includes coil section 1, magnetic core 2, and terminal sections 3. Magnetic core 2 is formed by covering coil section 1 with a mixture of magnetic material powder and insulating binder, before pressure-molding. Terminal sections 3 are electrically connected to coil section 1, and are bent along lateral faces and a bottom face of magnetic core 2. This coil component is soldered to mounting board 4 with solder 5 (e.g. disclosed in patent literature 1).

CITATION LIST

Patent Literature 1: Unexamined Japanese Patent Application Publication No. 2005-310868

SUMMARY OF THE INVENTION

The present invention provides a coil component excellent in vibration proof although the coil component becomes large in size. The coil component of the present invention includes a coil section, an outer package, and a pair of outer electrodes. The outer package is made of magnetic material, and the coil section is embedded in the outer package. The outer package has a bottom face, a top face disposed opposite the bottom face, a first lateral face, and a second lateral face placed opposite the first lateral face, and the top face is provided with cut-out sections. The pair of outer electrodes extends from both ends of the coil section, respectively, and come out from the first lateral face, and then is bent at a first bending section toward the bottom face, yet is bent at a second bending section toward the second lateral face and extends along the bottom face. Further, the pair of outer electrodes is bent at a third bending section toward the top face and extends along the second lateral face. The pair of outer electrodes is then bent at a fourth bending section toward the cut-out sections of the top face and is engaged with the cut-out sections, respectively. The bottom face is provided with recesses at places overlapped with the pair of outer electrodes, respectively. Each one of pair of the electrodes is bent to form a projection protruding inside of one of the recesses. Inside the second bending section, a notch having an opening that spreads over the first lateral face and the bottom face is formed. Inside the third bending section, a notch having an opening that spreads over the bottom face and the second lateral face is formed. Vertex portions of the second bending section and the third bending section inside each one of the notches are curved.

The structure discussed above allows forming the outer electrodes across the bottom face, and the outer electrodes bent along the recesses allow the outer package to be in closely contact with the outer electrodes. As a result, the vibration proof can be improved. When the outer electrodes are bent, the opening of each of the notches allows avoiding a point-contact between a corner of the outer package and each of the outer electrodes. When the outer electrodes are bent along the recesses, each of the outer electrodes at a section along the bottom face of the outer package is drawn to one of the recesses while the curved vertex portions of the second and the third bending sections inside the notches deform. This mechanism allows the outer electrodes to be bound more tightly around the outer package.

DESCRIPTION OF EMBODIMENTS

Figure 16:
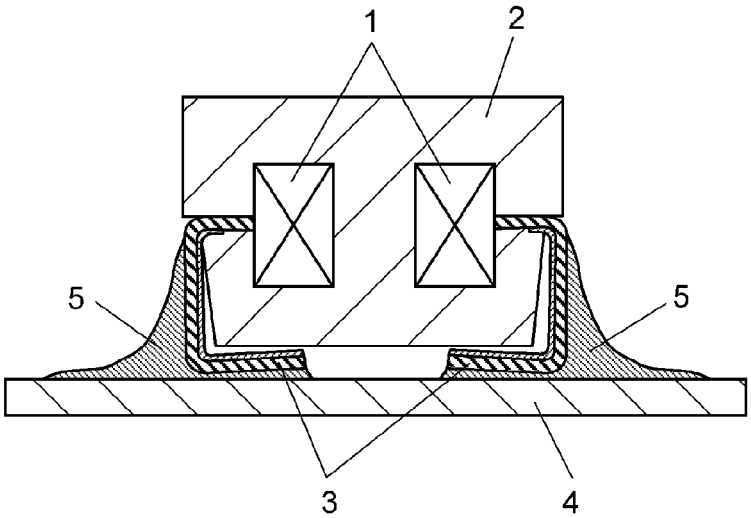
FIG. 16 PRIOR ART
FIG. 16 is a lateral sectional view of a conventional coil component mounted to a mounting board.

Prior to entering into the demonstration of the embodiments, the problems of the conventional coil components are described. A coil component for working with a large current is large in size, so that vibration proof should be carefully studied particularly for a car use. To be more specific, the coil component shown in FIG. 16 is large in size, and when its height becomes higher, vibrations applied to this coil component invite greater stress to its soldered sections. The mechanical strength at terminal sections 3 or the soldered sections thus may be weakened.

The coil component excellent in vibration proof, although it is large in size, is demonstrated hereinafter in the embodiments below with reference to the accompanying drawings.

First Exemplary Embodiment

Figure 1:
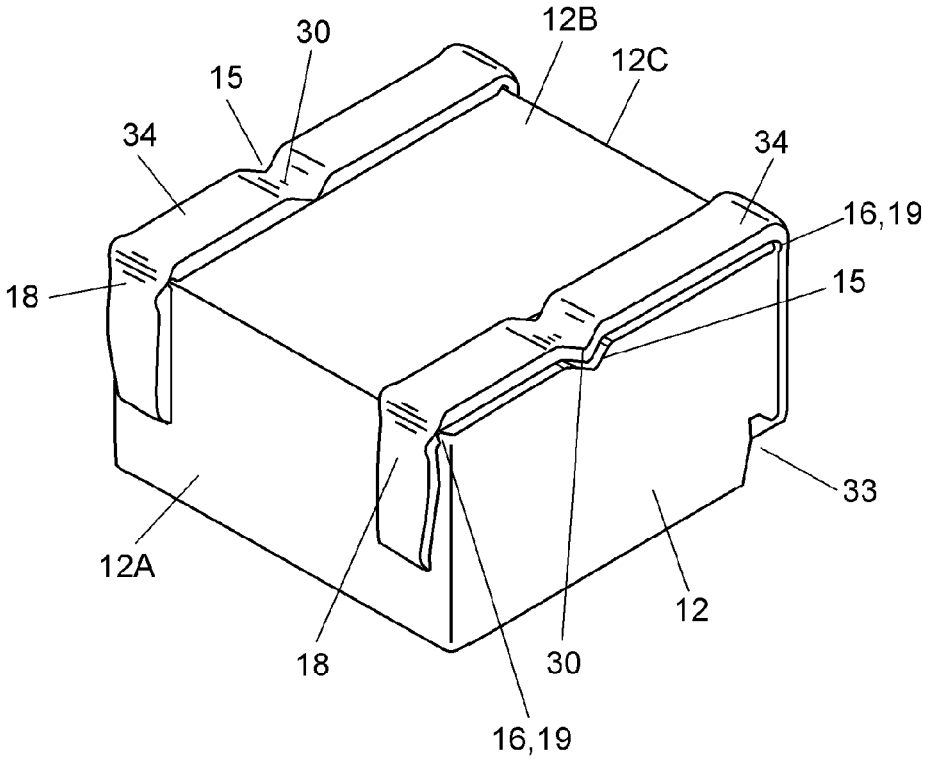
FIG. 1 is a perspective view of a coil component, viewed from its bottom side, in accordance with a first embodiment of the present invention.
Figure 2:
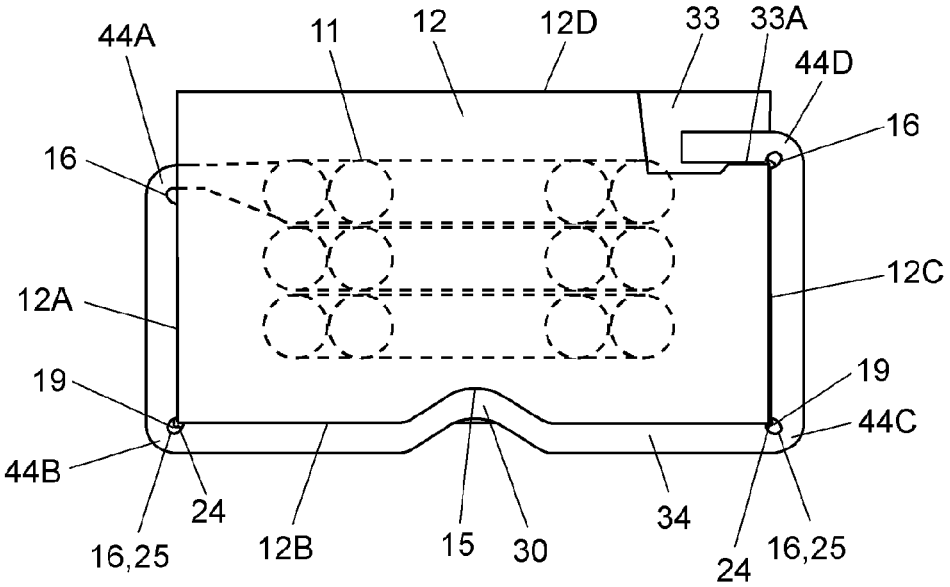
FIG. 2 is a lateral view of the coil component shown in FIG. 1.

FIG. 1 is a perspective view of a coil component, viewed from its bottom side, in accordance with the first embodiment. FIG. 2 is a lateral view of the coil component shown in FIG. 1. This coil component includes coil section 11, outer package 12, and a pair of outer electrodes 34.

Outer package 12 is made of magnetic material, and coil section 11 is embedded therein. Outer package 12 has bottom face 12B and top face 12D opposite bottom face 12B. Top face 12D is provided with cut-out sections 33. Outer package 12 also has first lateral face 12A and second lateral face 12C opposite first lateral face 12A.

Outer electrodes 34 extend from both ends of coil section 11 respectively, and come out from first lateral face 12A of outer package 12. Each of electrodes 34 is bent at first bending section 44A toward bottom face 12B, extends along first lateral face 12A, and is further bent at second bending section 44B toward second lateral face 12C and extends along bottom face 12B. Each of outer electrodes 34 is then bent at third bending section 44C toward top face 12D, extends along second lateral face 12C, is bent at fourth bending section 44D toward respective one of cut-out sections 33 of top face 12D, and is engaged with the respective one of cut-out sections 33.

Bottom face 12B is provided with recesses 15 at places overlapped with respective outer electrodes 34, each of which includes projection 30 that is bent to protrude toward inside of corresponding one of recesses 15.

Inside second bending section 44B, there is notch 16 having an opening that spreads over first lateral face 12A and bottom face 12B. In a similar manner, notch 16 having an opening that spreads over bottom face 12B and second lateral face 12C is formed inside third bending section 44C. Vertex portion 25 inside each of notches 16 formed at second bending section 44B and third bending section 44C respectively is curved.

The structural elements discussed above are demonstrated one by one hereinafter with examples. Coil section 11 is formed by winding a conductive wire, for instance, a copper wire covered with insulating material, in a helical shape. Outer package 12 is made of a mixture of magnetic powder and binder, and then is pressure-molded. Coil section 11 is embedded in outer package 12. The magnetic powder is metal powder produced by, for instance, grinding an alloy of Fe, Si, and Cr. The conductive wire is, for instance, a round wire having a diameter of approx. 1.2 mm. Outer package 12, for instance, has a bottom face of approx. 13 mm×13 mm, and has a height of approx. 7 mm.

Both ends of coil section 11 are drawn out from first lateral face 12A of outer package 12, and are bent at the drawn-out place (first bending section 44A) toward bottom face 12B. Both of these ends are then bent so as to be along bottom face 12B and second lateral face 12C, and are further bent toward cut-out sections 33 formed on top face 12D. Each end of outer electrodes 34 is engaged with cut-out section 33. Each of outer electrodes 34 thus extends across bottom face 12B from first lateral face 12A to second lateral face 12C.

Each end of coil section 11 is drawn out from first lateral face 12A. The insulating cover is removed from the surface of each end of coil section 11. Each end of coil section 11 is rigidly mounted on the surface of outer package 12 along first lateral face 12A, bottom face 12B and second lateral face 12C, whereby outer electrode 34 is formed. Outer electrode 34, which is a part of the ends of coil section 11, is shaped like a plate by pressing the round wire. A thickness of outer electrode 34 is, for instance, approx. 0.5 mm. Coil section 11 can be formed of, for instance, a rectangle wire instead of the round wire. Outer electrode 34 can be formed by deforming the both ends of coil section 11 into a plate-like shape.

Each one of cut-out sections 33 is provided with step section 33A closer to bottom face 12B rather than to top face 12D. Each one of outer electrodes 34 is preferably bent to stride over step section 33A.

As discussed above, the ends of coil section 11 are bent toward cut-out sections 33 formed on top face 12D of outer package 12, whereby the ends of coil section 11 as outer electrodes 34 are fixed to outer package 12. However, it is difficult for outer electrodes 34 to extend solidly along first lateral face 12A, bottom face 12B, and second later al face 12C, because the structure discussed above tends to invite only a point contact between each of outer electrodes 34 and outer package 12 at the corners of package 12. In other words, outer electrode 34 tends to touch outer package 12 only at a place where first lateral face 12A adjoins to bottom face 12B and at a place where second lateral face 12C adjoins to bottom face 12B.

To overcome this problem, recesses 15 are formed on bottom face 12B at places overlapped with outer electrodes 34 respectively, and each of outer electrodes 34 is bent to fit into respective recesses 15 for tightly binding itself around outer package 12. Each of outer electrodes 34 resultantly includes projection 20 bent so as to protrude inward recess 15. A depth of recess 15 is, for instance, approx. 0.6 mm. This structure achieves a face-contact between outer electrodes 34 and first lateral face 12A, bottom face 12B, second lateral face 12C. Recesses 15 are formed on bottom face 12B excluding the boundaries to first lateral face 12A and to second lateral face 12C.

On top of that, outer electrode 34 is provided with notches 16, at least, at the inside of second bending section 44B and at the inside of third bending section 44C out of four bending sections. The presence of notches 16 prevents the bend sections of outer electrodes 34 from getting out of position, so that outer electrodes 34 can be closely bound around outer package 12.

Notch 16 is detailed hereinafter also with reference to FIG. 3A-FIG. 3C, which are lateral views of examples of thinner part 23 of outer electrode 34.

Notch 16 is formed by bending thinner part 23 formed in advance on outer electrode 34 at a position to be bent when the round wire is pressed for forming outer electrode 34. In other words, the minimum thickness Ht of outer electrode 34 at the thinner part 23 is smaller than the thickness Gt of the other parts.

Figure 3A:
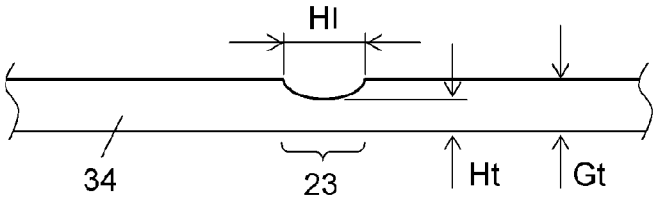
FIG. 3A is a lateral view of a thinner part of an outer electrode of the coil component in accordance with the first embodiment.
Figure 3B:
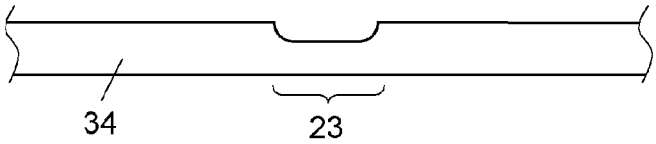
FIG. 3B is a lateral view of another thinner part of the outer electrode of the coil component in accordance with the first embodiment.
Figure 3C:
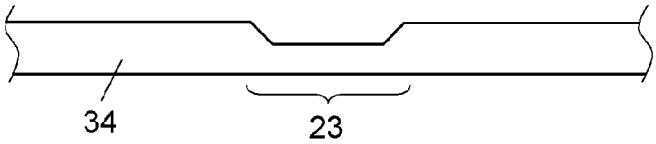
FIG. 3C is a lateral view of yet another thinner part of the outer electrode of the coil component in accordance with the first embodiment.

The top face of thinner part 23 shown in FIG. 3A forms a curved face, and the top face of thinner part 23 shown in FIG. 3B is formed by combining a flat face and a curved face. The top face of thinner part 23 shown in FIG. 3C is formed by combining a flat face and slopes. As discussed above, the shape of the top face of thinner part 23 is thus not necessarily specified. To maintain the strength of outer electrode 34, the minimum thickness Ht of thinner part 23 is preferably equal to 0.5 times of thickness of a flat part of outer electrode 34 or greater.

After thinner part 23 is bent, opening 24 is formed inside notch 16 as shown in FIG. 2. Opening 24 at second bending section 44B spreads over bottom face 12B and first lateral face 12A. Opening 24 at third bending section 44C spreads over bottom face 12B and second lateral face 12C. Vertex portion 25 inside each one of notches 16 of second bending section 44B and third bending section 44C is curved.

The presence of openings 24 of notches 16 allows preventing a point-contact between a corner of outer package 12 and outer electrode 34 when outer electrode 34 is bent.

When each of outer electrodes 34 is bent to fit into recess 15, outer electrode 34 at a section along bottom face 12B is drawn to recess 15 while curved vertex portions 25 inside notches 16 deform. This mechanism allows binding outer electrodes 34 more tightly around outer package 12.

As outer electrode 34 is bound more tightly, the corners of outer package 12 enter openings 24 of notches 16, so that outer electrodes 34 can be easily brought into face-contact with first lateral face 12A, bottom face 12B, and second lateral face 12C.

As shown in FIG. 2, notches 16 may be formed at the inside of first bending section 44A and at the inside of fourth bending section 44D. The structure make outer electrodes 34 to be more easily brought into face-contact with first lateral face 12A and second lateral face 12C.

Length HI of thinner part 23 in an extending direction of outer electrode 34 (horizontal direction in FIG. 3A-FIG. 3C) is preferably in a range from 0.05 times to 0.20 times, inclusive, of the height of outer package 12. The height of outer package 12 refers to a distance between top face 12D and bottom face 12B. The reason of this preferable length is described hereinafter with reference to FIG. 4 which is a lateral view of a more preferable coil component in accordance with the embodiment.

Figure 4:
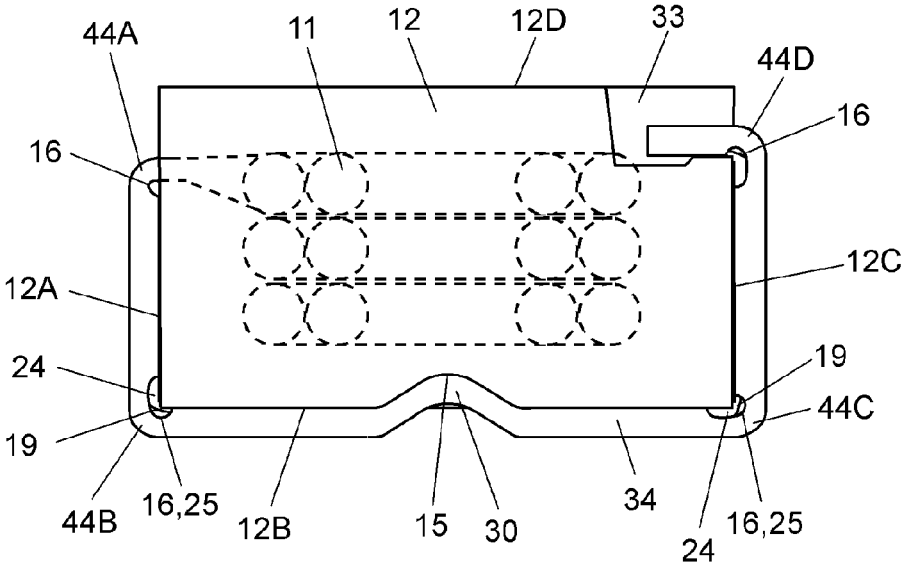
FIG. 4 is a lateral view of another coil component in accordance with the first embodiment.

If thinner part 23 has length HI equal to 0.05 times of the height of outer package 12 or greater, vertex portion 25 of the bending section inside the notch 16 can form a curve. If thinner part 23 has length HI in a range from 0.05 times to 0.20 time, inclusive, of the height of outer package 12, greater opening 24 is obtainable. As shown in FIG. 4, these dimensions allow each of openings 24 to prevent a point contact between the corners of outer package 12 and outer electrode 34 when outer electrode 34 is bent even if there are some variations in the height of outer package 12. As a result, dimensional variations caused by the pressure-molding of outer package 12 can be absorbed.

If length HI is smaller than 0.05 times of the height of outer package 12, it is difficult for vertex portion 25 to form a curve. If length HI is greater than 0.20 times of the height of outer package 12, outer electrode 34 includes a greater area of the thinner part, so that the strength of outer electrode 34 decreases.

Meanwhile, length HI of thinner part 23 to be second bending section 44B in outer electrode 34 can be shorter than length HI of thinner part 23 to be third bending section 44C. The variations in height of outer package 12 less affect thinner part 23 to be second bending section 44B than thinner part 23 to be third bending section 44C. Length HI of thinner part 23 to be second bending section 44B can be thus shortened. This structure prevents the strength of second bending section 44B from lowering.

Outer electrode 34 including thinner parts 23 is solder-dipped for plating electrode 34 with solder, and then is bent. This process (sequence) preferably forms solder lumps 19, each of which thickness is greater than that of the other parts, attached to thinner parts 23 at vertex portions 25 inside notches 16. This structure allows solder lumps 19 to melt when the coil component is mounted to the mounting board by soldering, whereby the solder on the mounting board is drawn into notches 16. As a result, the strength of solder joints increases.

In the case of soldering the foregoing coil component onto the mounting board, outer electrodes 34 across bottom face 12B, and closely attached to first lateral face 12A and second lateral face 12C are soldered to the mounting board. This structure allows the coil component to be excellent in vibration proof. On top of that, a rather greater amount of solder gathers around recesses 15, and this structure also gives an advantage about the vibration proof to the coil component.

Solder lumps 19 formed at vertex portions 25 inside notches 16 melt into the solder on the mounting board, thereby rigidly mounting outer electrodes 34 to the mounting board from both of the front sides and the rear sides of outer electrodes 34. This structure also acts advantageously for vibration proof.

If solder lumps 19 melt earlier than the solder on the mounting board when outer electrodes 34 are reflow-soldered onto the mounting board, the solder on the mounting board can be easily drawn to notches 16. It is thus desirable that the material for solder lumps 19 has a melting point lower than that of the solder on the mounting board. Use of such a material allows the reflow solder and solder lumps 19 to melt together with ease. In general, the mounting board uses the solder of which melting point falls within a range from 215° C. to 230° C., inclusive. The material for solder lumps 19 thus desirably has a melting point falling within a range from 195° C. to 215° C., inclusive.

Figure 5:
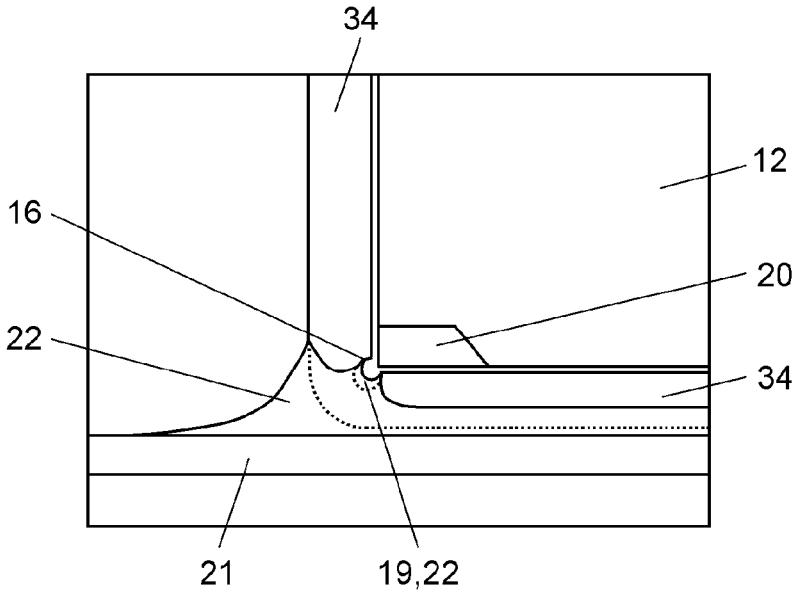
FIG. 5 is an enlarged lateral view showing an essential part of still another coil component mounted to a mounting board in accordance with the first embodiment.

As FIG. 5 shows, outer package 12 may be cut out at a section confronting notch 16 where solder lump 19 is formed, for forming void 20. FIG. 5 is an enlarged view of an essential part of the coil component mounted on the mounting board, and the coil component is formed of a preferable structure in accordance with this embodiment. This structure allows hot air to pass through void 20, so that solder lump 19 tends to be warmed at the time of the reflow-soldering. As a result, the solder on the mounting board and solder lump 19 melt together with ease.

Figure 6:
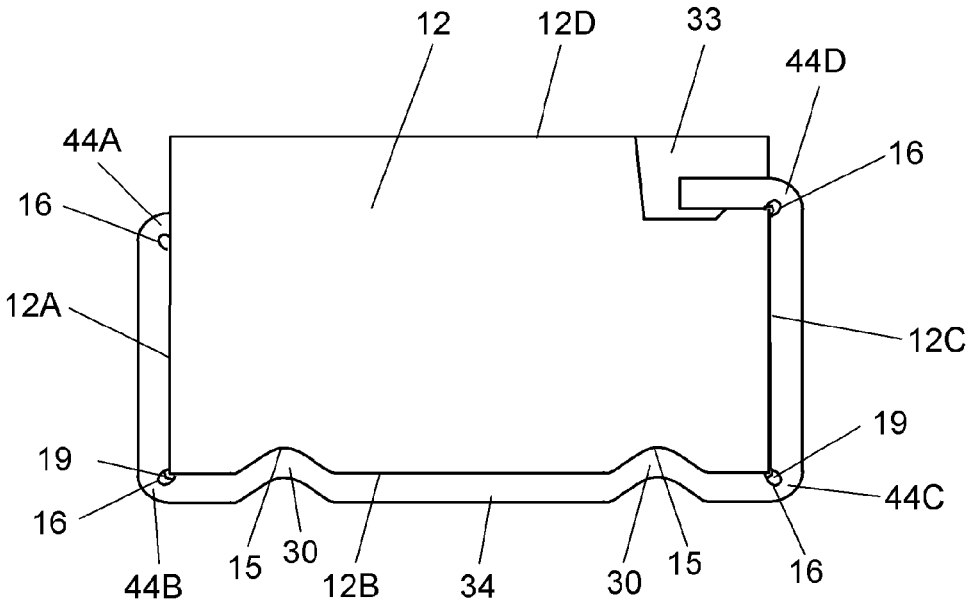
FIG. 6 is a lateral view of yet another coil component in accordance with the first embodiment.

In FIG. 2, one recess 15 is formed per outer electrode 34 on bottom face 12B at the center of the section where outer electrode 34 is overlaid, however, as FIG. 6 shows, multiple recesses per outer electrode 34 can be formed. FIG. 6 is a lateral view of another coil component in accordance with this embodiment.

The presence of recesses 15 reduces a thickness of the magnetic material of outer package 12 at those particular places where recesses 15 are formed, thereby inviting magnetic saturation with ease. The center section of bottom face 12B overlays outer electrode 34, and is near coil section 11 among other sections, so that the magnetic saturation tends to occur at this center section. To overcome this problem, recesses 15 are desirably formed at both sides of this center section as shown in FIG. 6. Preparing recesses 15 at the places other than the center section as discussed above will keep the thinner magnetic material sections away from coil section 11. The magnetic saturation is thus hard to occur, and outer electrode 34 can bind itself around outer package 12 with greater strength. As a result, the depth of recesses 15 can be reduced, and yet, the magnetic saturation is harder to occur.

Preparing two projections 30 for one outer electrode 34 involves four recesses 15 on outer package 12. When this coil component is soldered to another item, the solder gathers around recesses 15 in a greater amount than other places. As a result, the strength increases against rotating force about the winding axis of coil section 11.

Next, a preferable shape of each of recesses 15 is demonstrated hereinafter with reference to FIG. 7, which is a lateral view of still another coil component in accordance with the present embodiment.

Figure 7:
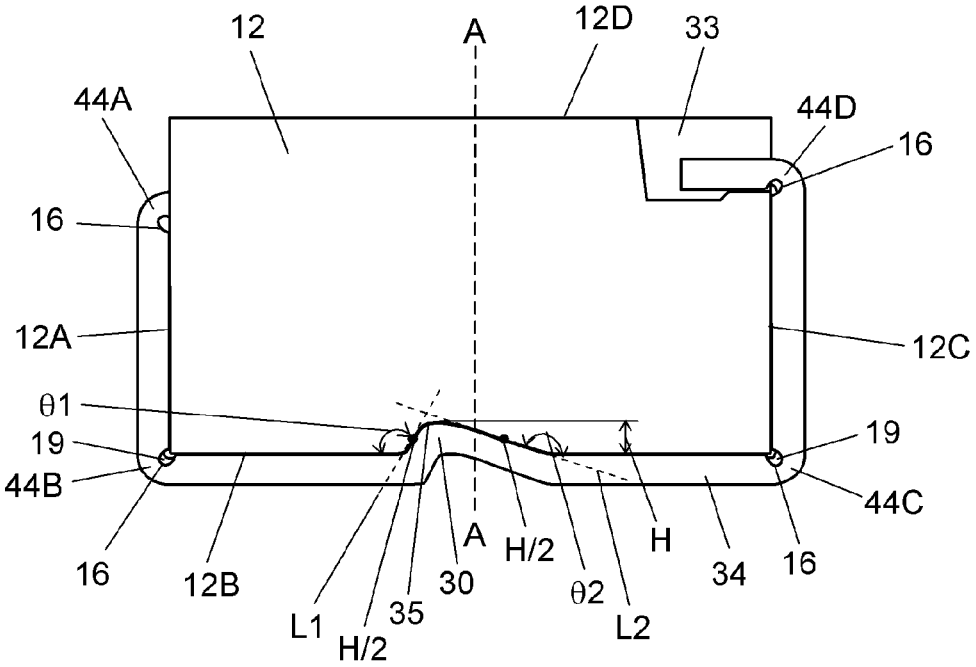
FIG. 7 is a lateral view of yet still another coil component in accordance with the first embodiment.

The coil component shown in FIG. 7 is provided with recesses 35 each formed asymmetrically relative to a plane (cut along line A-A) perpendicular to the extending direction of outer electrodes 34. To be more specific, the shape of each recess 35 can be defined as follows: Assume that a depth of recess 35 is H, and draw a tangent line L1 in contact with recess 35 at H/2 on the first lateral face 12A side, and another tangent line L2 in contact with recess 35 at H/2 on the second lateral face 12C side. Tangent lines L1 and L2 form respectively angles with bottom face 12B. The angle on the first lateral face 12A side is θ1 and the other angle on the second lateral face 12C side is θ2, and the relation of θ1<θ2 is satisfied.

After the preparation of recesses 35, outer electrodes 34 are bent to fit into recesses 35 by using a punch (not shown) having a shape similar to each recess 35. Then the portion of each outer electrode 34 at the smaller angle θ1 side is sandwiched between outer package 12 and the punch, and engaged with outer package 12 strongly sooner than the portion on the greater angle θ2 side, and will not move anymore. When the punch is pushed further into recess 35, the portion of outer electrode 34 at the angle θ2 side is drawn into recess 35, whereby outer electrode 34 can more strongly bind the portion of outer package 12 at the second lateral face 12C side. This structure thus corrects looseness, produced by spring back on outer electrode 34 engaged with cut-out section 33 on the second lateral face 12C side.

In FIG. 2 and FIG. 7, recess 15 or recess 35 is provided around the center section of bottom face 12B and each outer electrode 34 overlays the center section; however, the recess can be provided nearer to second lateral face 12C than the center section. In this case, the portion of outer package 12 at second lateral face 12C side can be more strongly bound.

Figure 8:
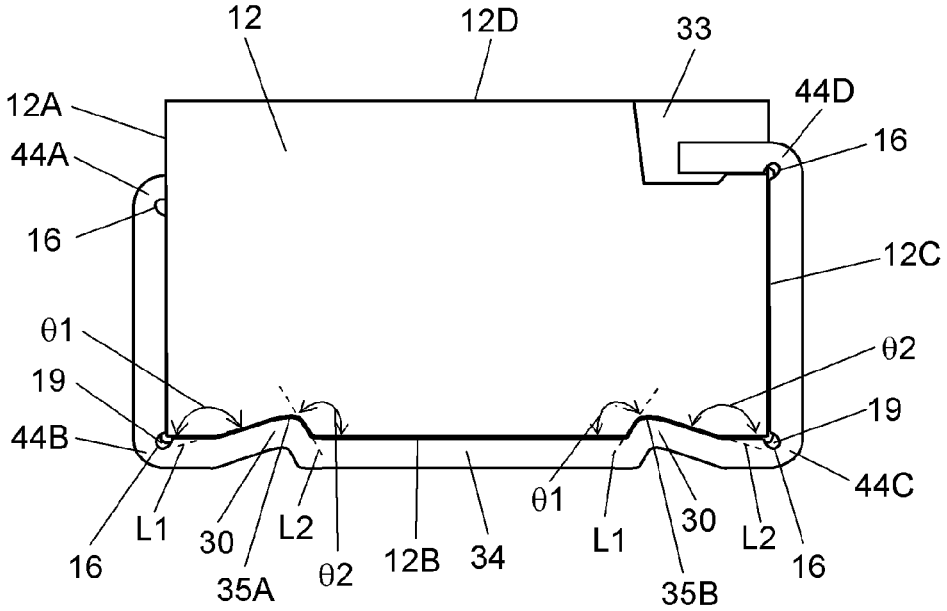
FIG. 8 is a lateral view of another coil component in accordance with the first embodiment.

Further, as shown in FIG. 8, two asymmetric recesses 35A and 35B similar to recess 35 can be formed for each outer electrode 34. FIG. 8 is a lateral view of yet another coil component in accordance with the present embodiment.

In this coil component, recess 35A closer to first lateral face 12A satisfies the relation of θ1>θ2, and recess 35B closer to second lateral face 12C satisfies the relation of θ1<θ2, where angles θ1 and θ2 are defined in the same way as illustrated in FIG. 7. The section of outer package 12 between recess 35A and recess 35B is pulled toward both of recess 35A and recess 35B, so that the closer or the more solid contact between outer electrode 34 and outer package 12 can be expected with less force applied thereto.

Figure 9:
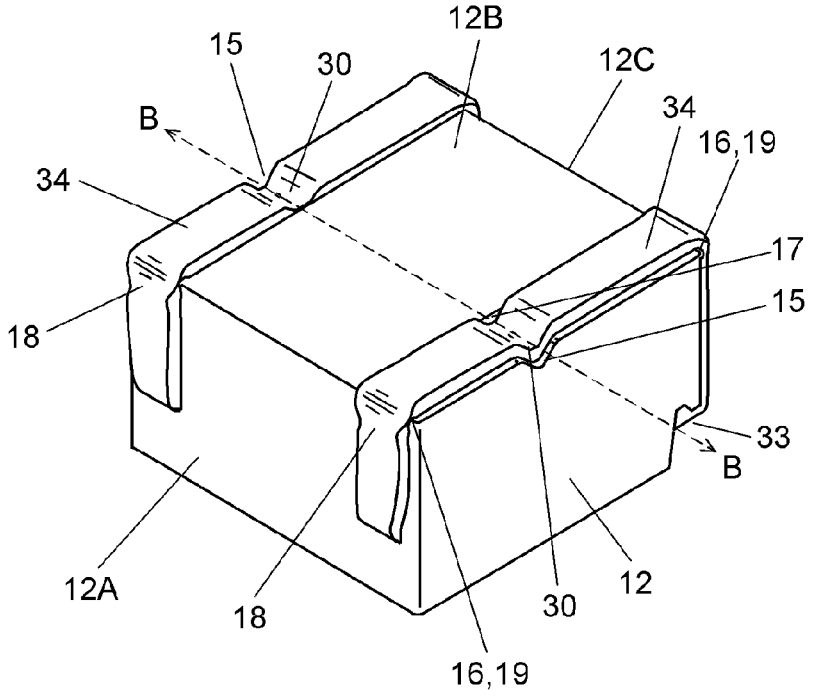
FIG. 9 is a perspective view of another coil component, viewed from its bottom side, in accordance with the first embodiment.

Meanwhile, as FIG. 9 shows, steps 17 each having a height less than the thickness of outer electrode 34 can be provided to bottom face 12B at places with which outer electrodes 34 are brought into contact. FIG. 9 is a perspective view of yet still another coil component, viewed from its bottom face side, in accordance with the present embodiment.

Presence of steps 17 increases the strength against force applied along a direction (direction along B-B line in FIG. 9) perpendicular to the extending direction of each outer electrode 34.

Figure 10:
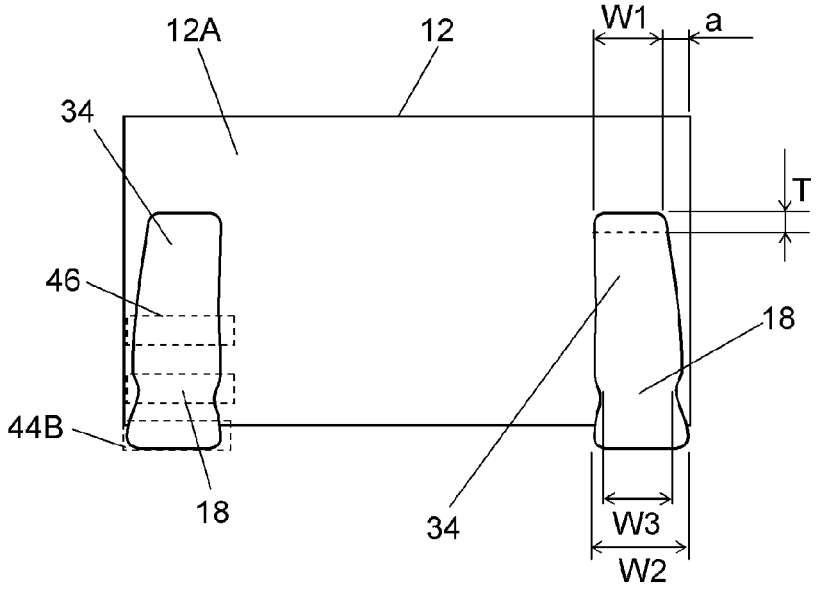
FIG. 10 is a lateral view showing a first lateral face of the coil component shown in FIG. 1.

A preferable shape of outer electrode 34 is demonstrated hereinafter. FIG. 10 is a lateral view of first lateral face 12A of the coil component in accordance with the present embodiment.

Each of outer electrodes 34 is drawn out from first lateral face 12A of outer package 12. Width W1 of the drawn out portion of outer electrode 34 is, for instance, approx. 1.6 mm, and thickness T thereof is approx. 0.4 mm. The side end of drawn-out outer electrode 34 is located at position (a) inward by approx. 0.5 mm from the end of first lateral face 12A. Drawn-out outer electrode 34 is bent toward bottom face 12B. The second bending section 44B of electrode 34 around bottom face 12B has width W2 of approx. 2.2 mm. If outer package 12 is compacting-molded with outer electrodes 34 being drawn-out from outer package 12, outer package 12 tends to suffer cracks around the section where outer electrode 34 is drawn out. To overcome this problem, the distance from the end of third lateral face 12E or fourth lateral face 12F to the drawn-out position (a) of outer electrode 34 from outer package 12 is preferably greater than thickness T of outer electrode 34. This structure prevents the cracks from being produced.

On the other hand, the side edge of the portion of each outer electrode 34 extending on bottom face 12B is preferably placed near the edge of outer package 12 because of the heat applied at the time of the reflow-soldering. To be more specific, width W2 of the second bending section 44B around bottom face 12B is preferably wider than width W1 of the drawn-out section from package 12. This structure allows drawn-out outer electrode 34 at second bending section 44B to be formed near the edge of outer package 12 even if outer electrode 34 drawn out from outer package 12 is extended substantially straight down toward bottom face 12B.

Each outer electrode 34 preferably includes narrowed section 18 along first lateral face 12A. Narrowed section 18 has width W3 of approx. 1.8 mm. When the coil component is soldered to a printed wiring board, solder fillet is formed on outer electrode 34 at a place along the lateral face. A greater height of the coil component will allow the solder fillet to rise higher, so that a shape of the solder fillet tends to vary. However, the presence of narrowed section 18 prevents the solder fillet from rising higher than narrowed section 18, so that a stable shape of the solder fillet can be expected. Narrowed section 18 is more preferably formed on first lateral face 12A at a place nearer to bottom face 12B than to center section 46 along the extending direction of outer electrode 34 so that the advantage discussed above can be obtained.

Second Exemplary Embodiment

Figure 11:
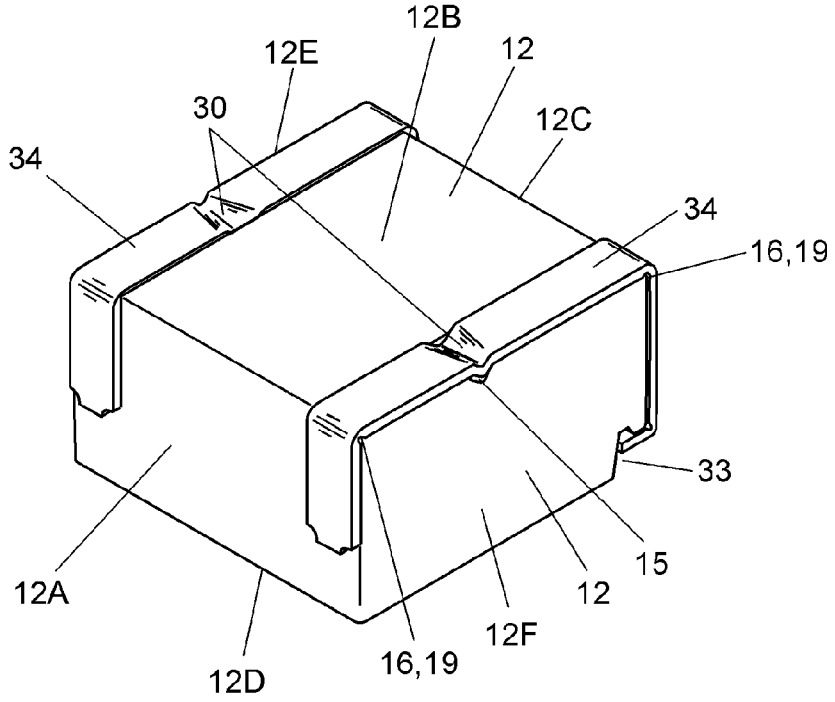
FIG. 11 is a perspective view of a coil component, viewed from its bottom side, in accordance with a second embodiment of the present invention.
Figure 12:
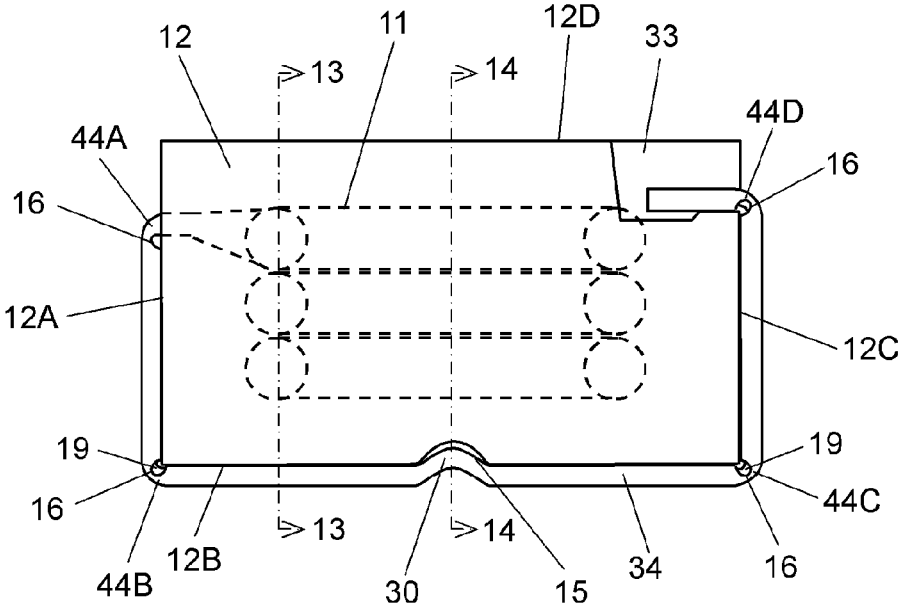
FIG. 12 is a lateral view of the coil component shown in FIG. 11.
Figure 13:
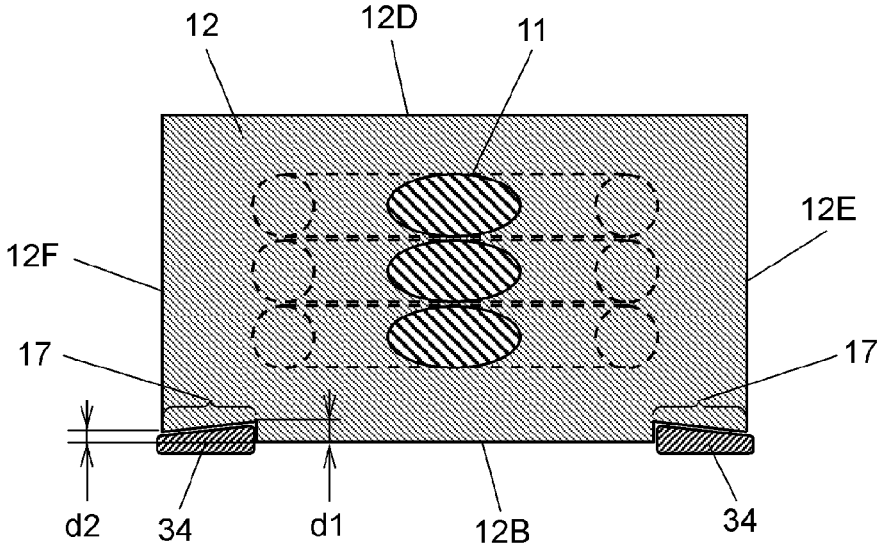
FIG. 13 is a sectional view of the coil component cut along line 13-13 in FIG. 12.
Figure 14:
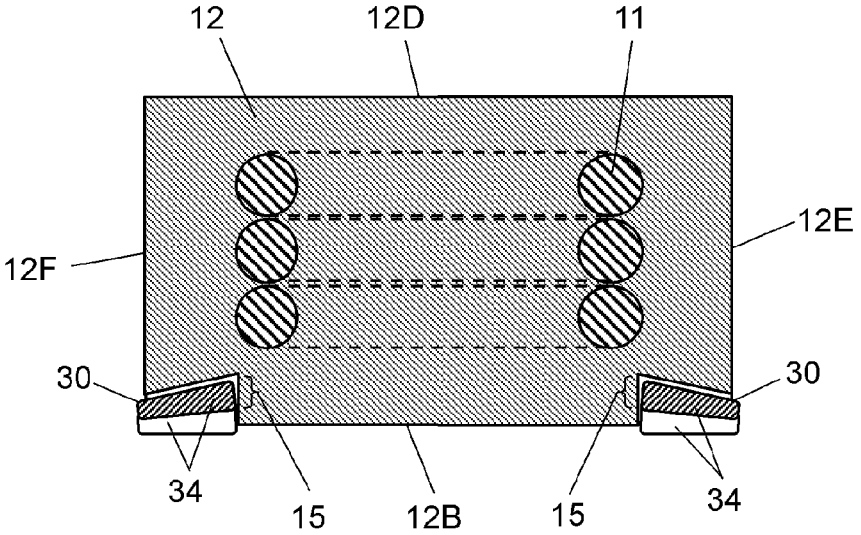
FIG. 14 is a sectional view of the coil component cut along line 14-14 in FIG. 12.

A coil component in accordance with the second embodiment is demonstrated hereinafter with reference to FIG. 11-FIG. 14. FIG. 11 is a perspective view of the coil component, viewed from its bottom side, in accordance with the second embodiment. FIG. 12 is a lateral view of the coil component shown in FIG. 11. FIG. 13 is a sectional view cut along line 13-13 in FIG. 12. FIG. 14 is a sectional view cut along line 14-14 in FIG. 12. Structural elements similar to those in the first embodiment have the same reference marks and the detailed descriptions thereof may be omitted.

As shown in FIG. 13, steps 17 are provided to bottom face 12B at places with which outer electrodes 34 are in contact, and a depth of each of steps 17 on the center side is greater than a depth thereof on the lateral face side. In other words, a height of step 17 on the center side of bottom face 12B is greater than a height thereof on the other side, namely, nearer to third lateral face 12E or fourth lateral face 12F. For instance, depth d1 of step 17 on the center section side of bottom face 12B is approx. 0.4 mm, and depth d2 on the lateral face side is approx. 0.2 mm.

As described previously, each outer electrode 34 is formed by pressing the round wire of coil section 11, and shapes like a plate. Outer electrode 34 in contact with bottom face 12B is thicker at the center side of bottom face 12B than at the lateral face side. For instance, the thickness on the center side is approx. 0.6 mm and the thickness at the lateral face side is approx. 0.4 mm. This structure allows outer electrodes 34 to resist the stress applied from the center side of bottom face 12B toward the lateral faces, so that outer electrodes 34 are hard to come out from outer package 12, and the vibration proof can be increased. In addition, modifying the shape of each outer electrode 34 to fit to respective step 17 can make the mounting face of the coil component flat.

When the coil component is viewed from third lateral face 12E which is perpendicular to first lateral face 12A and second lateral face 12C, it is preferable that the lateral face of outer electrode 34 is entirely exposed. This entire exposure increases an area subjected to hot air when reflow-soldering is performed, so that heat absorption can be improved, and the soldering can be done more efficiently. Solder fillet can be formed also on the lateral face of outer electrode 34, so that vibration proof is further strengthened.

As shown in FIG. 14, recesses 15 are provided inside steps 17 formed on bottom face 12B. A depth of each recess 15 nearer on the center side of bottom face 12B is greater than a depth thereof on the lateral face side. For instance, the depth of recess 15 on the center side is approx 0.6 mm measured from step 17, and the depth thereof on the lateral face side is approx. 0.4 mm measured from step 17.

Each outer electrode 34 is pushed toward recess 15, thereby fastening outer electrode 34. To be more specific, projection 30 protrudes into recess 15 more deeply on the center section side of bottom face 12B than on third lateral face 12E side or fourth lateral 12F side. This structure ensures the face-contact more positively between outer electrode 34 and each of first lateral face 12A, bottom face 12B, and second lateral face 12C.

When this coil component is soldered to another item, each outer electrode 34 is used as a place to be soldered, and as discussed above, outer electrode 34 is in solid contact across bottom face 12B, and in solid contact with first lateral face 12A and second lateral face 12C. This structure strengthens the vibration proof of the coil component, and on top of that, the solder is gathered around recess 15 in a greater amount, so that the vibration proof is advantageously improved.

Meanwhile, each outer electrode 34 is pushed into recess 15 deeper on the center side of bottom face 12B than on third lateral face 12E side or fourth lateral face 12F side. For instance, the depth is approx 0.5 mm on the center side, and the depth is approx. 0.3 mm on the lateral face side. This structure allows outer electrodes 34 to resist the stress applied from the center side toward the lateral face side, so that outer electrodes 34 are hard to come out from outer package 12, and the vibration proof can be further improved.

As FIG. 11 shows, each recess 15 viewed from bottom face 12B side preferably has a width narrower on the center side of bottom face 12B than on the third lateral face 12E side or the fourth lateral face 12F side. This shape of recess 15 allows each outer electrode 34 to resist the stress applied from the center side of bottom face 12B toward the lateral face side, so that outer electrode 34 is hard to come out from outer package 12, and the vibration proof can be further improved.

The foregoing descriptions disclose that step 17 is formed across bottom face 12B, i.e. from first lateral face 12A to second lateral face 12C, at the place with which outer electrode 34 is in contact. However, step 17 is not necessarily formed across bottom face 12B, but it can be formed at least ⅓ length of the foregoing place for obtaining an advantage similar to what is discussed above.

Step 17 can be formed not only on bottom face 12B but also on first lateral face 12A and second lateral face 12C.

Figure 15:
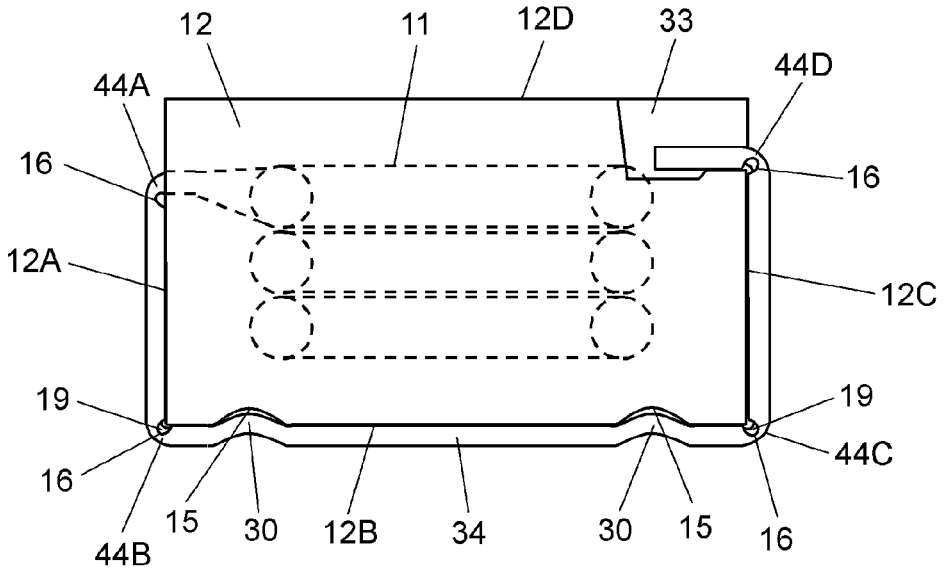
FIG. 15 is a lateral view of another coil component in accordance with the second embodiment.

Similar to the first embodiment, in the present embodiment, multiple recesses 15 per one outer electrode 34 can be formed as shown in FIG. 15 which is a lateral view of another coil component in accordance with the second embodiment. Multiple recesses 15 have been discussed already in the first embodiment, and the same advantage can be obtained also in this second embodiment. Although not illustrated in this second embodiment, recesses 35A and 35B as shown in FIG. 8 can be formed.

When the round wire of coil section 11 is pressed to form each outer electrode 34, it is preferable to provide notches 16 to outer electrode 34 at places supposed to be bent. A detailed shape of notches 16 and an advantage of providing notches 16 are the same as those discussed in the first embodiment.

INDUSTRIAL APPLICABILITY

The coil components in accordance with the present invention are useful for industrial use because they are excellent in vibration proof even if they are larger in size.

The invention claimed is:

1. A coil component comprising:

a coil section;

an outer package in which the coil section is embedded, the outer package being made of magnetic material, and having a bottom face, a top face opposite the bottom face, a first lateral face, and a second lateral face opposite the first lateral face, the top face being provided with cut-out sections; and a pair of outer electrodes extending from both ends of the coil section respectively, drawn out from the first lateral face, bent at a first bending section toward the bottom face and extending along the first lateral face, further bent at a second bending section toward the second lateral face and extending along the bottom face, further bent at a third bending section toward the top face and extending along the second lateral face, and further bent at a fourth bending section toward the cut-out section formed on the top face, then engaged with the cut-out sections, wherein the bottom face is provided with recesses at places overlapped with the pair of outer electrodes, respectively, and each one of pair of the outer electrodes is bent to form a projection protruding toward inside of one of the recesses, wherein a notch is disposed inside the second bending section, and the notch includes an opening that spreads over the first lateral face and the bottom face, wherein a notch is disposed inside the third bending section, and the notch of the third bending section includes an opening that spreads over the bottom face and the second lateral face, and wherein a vertex portion of the second bending section inside the notch of the second bending section is curved and a vertex portion of the third bending section inside the notch of the third bending section is curved.

2. The coil component according to claim 1,
wherein a plurality of recesses including one of the recesses is provided on the bottom face at places overlapped with each of the pair of outer electrodes, and
wherein each of the pair of outer electrodes has a plurality of projection including the projection and curved to protrude toward inside of the plurality of the recesses.

3. The coil component according to claim 1,
wherein each of the recesses is asymmetric with respect to a plane perpendicular to an extending direction of the pair of outer electrodes.

4. The coil component according to claim 1,
wherein a width of each of the pair of outer electrodes on the first lateral face at a drawn-out section from the outer package is smaller than a width of the second bending section.

5. The coil component according to claim 4,
wherein each of the pair of outer electrodes includes a narrowed section on the first lateral face between the drawn-out section from the outer package and the second bending section.

6. The coil component according to claim 5,
wherein the narrowed section is located closer to the second bending section than to a center section along an extending direction of each of the pair of outer electrodes on the first lateral face.

7. The coil component according to claim 1,
wherein the outer package further has a third lateral face and a fourth lateral face between the first lateral face and the second lateral face, and
wherein steps are formed on the bottom face of the outer package at sections in contact with the pair of outer electrodes, and a height of each of the steps is greater at a closer side to a center section of the bottom face than at a closer side to the third lateral face or the fourth lateral face.

8. The coil component according to claim 7,
wherein the recesses are formed in the steps, and the projection protrudes into one of the recesses deeper at a closer side to the center section of the bottom face than at a closer side to the third lateral face or the fourth lateral face.

9. The coil component according to claim 7,
wherein each of the pair of outer electrode has a portion in contact with the bottom face, and the portion is thicker at a side closer to the center section than at a side closer to the third lateral face or the fourth lateral face.

10. The coil component according to claim 1,
wherein surfaces of the pair of outer electrodes are plated with solder, and a solder lump thicker than other portions is formed inside each of the notches.

11. The coil component according to claim 10,
wherein a melting point of solder forming the solder lump falls within a range from 195° C. to 215° C., inclusive.

12. The coil component according to claim 10,
wherein a void is provided between the solder lump and the outer package.

13. The coil component according to claim 1,
wherein the notches are formed by bending thinner parts provided at least at a corner between the first lateral face and the bottom face, and at a corner between the bottom face and the second lateral face, before each of the pair of outer electrodes is bent, and
wherein a length of the thinner part along an extending direction of each of the pair of outer electrodes falls within a range from 0.05 times to 0.20 times, inclusive, of a distance between the top face and the bottom face of the outer package.

* * * * *